United States Patent [19]

Wiley et al.

[11] 4,284,318

[45] Aug. 18, 1981

[54] ELECTRIC PLUG

[75] Inventors: Roy O. Wiley, Huntington; Bruce A. Samborski, Enfield, both of Conn.

[73] Assignee: Westinghouse Electric Corp., Pittsburgh, Pa.

[21] Appl. No.: 21,653

[22] Filed: Mar. 19, 1979

[51] Int. Cl.[3] ..... H01R 13/595

[52] U.S. Cl. ..... 339/103 C; 339/195 M

[58] Field of Search ..... 339/103, 107, 110 P, 339/209, 136 M, 136 P, 139 R, 195 R, 195 M

[56] References Cited

U.S. PATENT DOCUMENTS

| | | | |
|---|---|---|---|
| 1,041,300 | 10/1912 | Kliegl | 339/103 C |
| 1,152,170 | 8/1915 | Goodridge | 339/196 R |
| 1,955,652 | 4/1934 | Pearson | 339/196 A |
| 2,174,383 | 9/1939 | Folsom | 339/196 M |
| 2,750,571 | 6/1956 | Schmier | 339/195 R X |
| 2,927,297 | 3/1960 | Hubbel | 339/196 |
| 3,195,100 | 7/1965 | Lee | 339/191 |
| 3,519,980 | 7/1970 | Mosley | 339/105 |
| 3,611,247 | 10/1971 | Adams et al. | 339/14 P |
| 3,739,318 | 6/1973 | Winter et al. | 339/103 C |
| 3,781,765 | 12/1973 | Schleicher | 339/103 R |
| 3,808,583 | 4/1974 | Liberman | 339/103 R |
| 4,021,092 | 5/1977 | Ericson, Jr. | 339/103 R |
| 4,067,634 | 1/1978 | Hoffman | 339/107 |
| 4,081,206 | 3/1978 | Lee | 339/195 M X |

*Primary Examiner*—Neil Abrams
*Attorney, Agent, or Firm*—G. H. Telfer

[57] ABSTRACT

An electric plug for use with an electrical cord and characterized by a base and cover of separately molded dielectric material, the base having a central cord-receiving opening and having electric conductor prongs extending from one end thereof and having a pair of integral posts extending from the other end thereof and on diametrically opposite sides of the cord opeing, a tubular cover enclosing the base and having an open end closed by said other end of the base and having a closed end with apertures through which the conductor prongs extend, and a pair of cord-clamping members adjustably mounted on the posts.

4 Claims, 5 Drawing Figures

ELECTRIC PLUG

BACKGROUND OF THE INVENTION

1. Field of the Invention

This invention relates to an electric plug and, more particularly, it pertains to an electric cord clamping device, a part of which is integral with the body of the electric plug.

2. Description of the Prior Art

Electric plugs of the "dead-front" construction are regarded as being safer than the so-called "live-front" type which has been in common use heretofore. Prior art patents which disclose the "dead-front" electrical plugs include U.S. Pat. Nos. 1,152,170; 1,955,652; 2,174,383; 2,927,297; 3,195,100; 3,519,980; 3,611,247; 3,781,765; 3,808,583; and 4,067,634.

Generally, the dead-front electrical plugs, such as disclosed in the foregoing patents, have been more costly to produce and less convenient to use than the live-front type for which reason they have not been widely accepted and used.

SUMMARY OF THE INVENTION

In accordance with this invention it has been found that the foregoing problem may be overcome by providing a dead-front electric plug for use at the end of an electrical cord, comprising a base and a cover comprised of electrically insulating material, the base including first and second end surfaces and having a cord-receiving opening therebetween, at least two conductor prongs extending from the second end surface, the cover comprising a tubular wall, an open end, and an opposite closed end wall which end wall has prong-receiving apertures, the tubular wall enclosing the base with the closed end wall adjacent to the second end surface and with the prongs extending through the apertures, the first end surface closing the open end of the cover, latching means between the base and the cover for holding them together, cordgripping means mounted on the first end surface and comprising post means and cord-clamping means, the post means extending from and being integral with the base and being comprised of a unified molded resinous material, the cord-gripping means comprising a pair of cord-clamping members attached to the post means and having interengaging means between the clamping members for gripping an electrical cord, and the first end surface having aligned keyways in diametrically opposite sides of the opening in a zone perpendicular to the post means and each cord-clamping member comprising a key in a correponding keyway.

The advantage of the electrical plug of this invention is that it involves lower production cost with improvements in manufacture and implements new safety features which conform to dead-front construction of wiring devices in accordance with the national electric code.

DESCRIPTION OF THE PREFERRED EMBODIMENT

Figure 1:
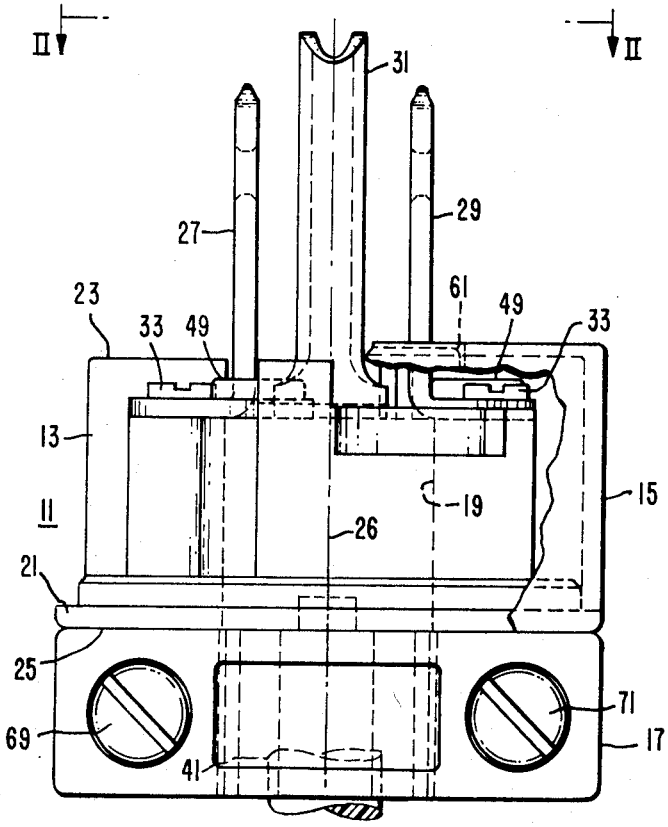
FIG. 1 is a side elevational view of the device of this invention.

In FIG. 1 an electric plug is generally indicated at 11 and it comprises a base 13, a cover 15, and cord-gripping means 17. All of the parts 11–17 are comprised of an electrically insulating material and preferably a long chain synthetic polymeric amide, such as nylon.

The base 13 is a molded member having an annular body portion forming a central opening 19 and having an enlarged head or flange 21. The base 13 also includes opposite end surfaces 23, 25 which extend substantially transversely of a longitudinal axis 26.

A number of prongs, including a hot prong 27, a neutral 29, and a ground prong 31, extend from the end surface 23 where they are secured by similar rivets 33 extending through terminals 35, 37, 39, respectively. An electric cable 41 extending into the opening 19 has three wires 43, 45, 47 which are secured to terminals 35, 37, 39 by similar screws 49.

Figure 4:
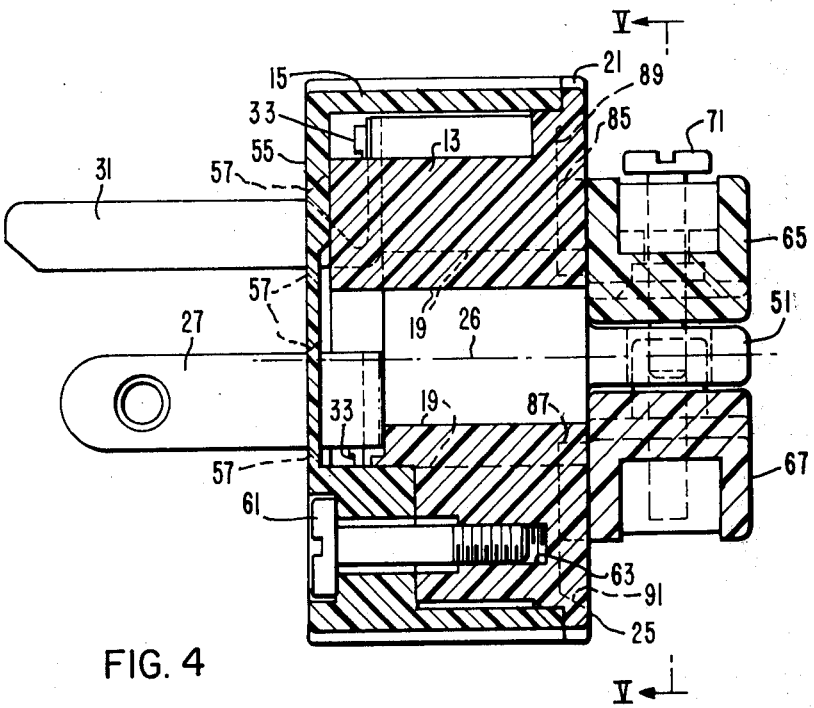
FIG. 4 is a sectional view taken on the line IV—IV of FIG. 2.
Figure 5:
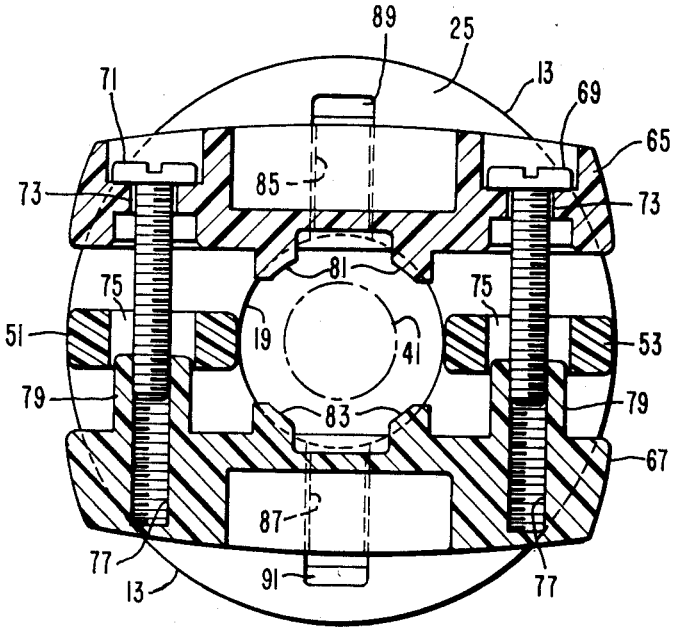
FIG. 5 is a sectional view taken on the line V—V of FIG. 4 and showing the clamping members in partially loosened positions.

As shown in FIGS. 4 and 5 the base 13 comprises a pair of upstanding posts 51, 53 extending from the end surface 25 on diametrically opposite sides of the opening 19. The posts 51, 53 are part of the cord-gripping means which is more fully disclosed hereinbelow.

Figure 2:
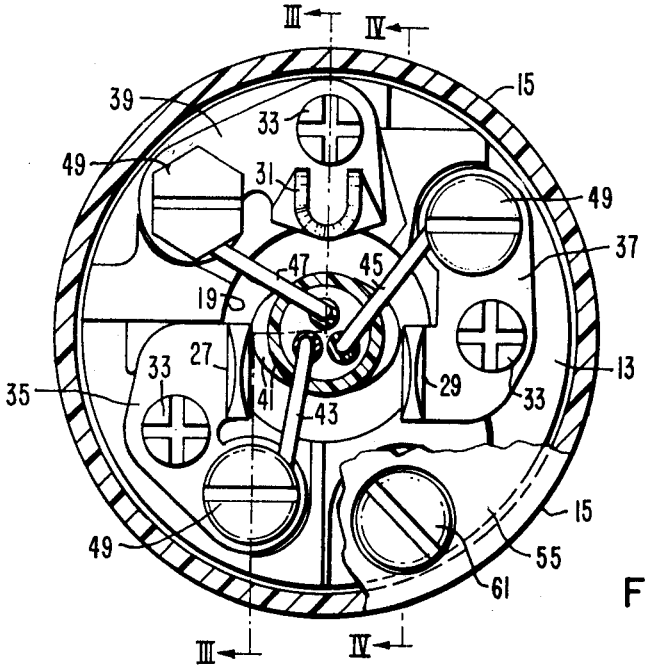
FIG. 2 is an end view with parts broken away taken on the line II—II of FIG. 1.
Figure 3:
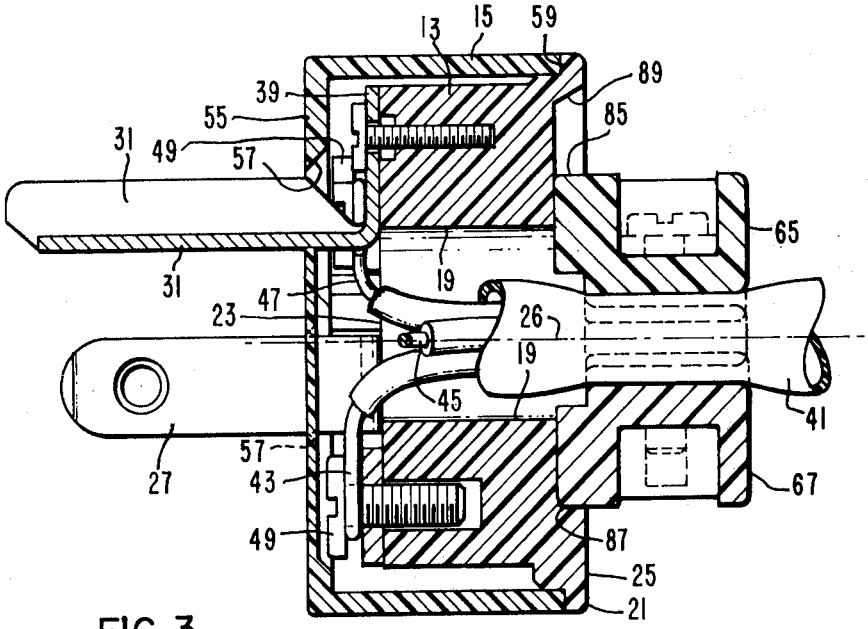
FIG. 3 is a sectional view taken on the line III—III of FIG. 2.

The cover 15 comprises a tubular wall, one end of which is open and the other end is closed by an end wall 55. The prongs 27, 29, 31 extend through similar apertures 57 in the end wall 55 when the cover 15 is in place on the base 13 as shown (FIGS. 3, 4). In that position the tubular wall of the cover 15 completely surrounds or encloses the base annular wall as well as the end surface 23 including the terminals 33, 37, 39, the wires 43, 45, 47, the rivets 33, the screws 49, and the opening 19. Accordingly, the end wall 55 of the cover 15 provides a so-called "dead-front", whereby only the prongs 27, 29, 31 are exposed. The open end of the cover opposite the end wall 55 is closed by the flange 21 at an annular surface 59 between the flange 21 and the cover 15. The cover 15 is retained in place by a screw 61 (FIGS. 2, 4) which is seated in a threaded opening 63 in the base 15.

In accordance with this invention the cordgripping means 17, including the posts 51, 53 (FIG. 5), also comprises a pair of cord clamps or clamping members 65, 67 (FIGS. 1, 3, 4 and 5). The cord clamps 65, 67 are mounted by a pair of screws 69, 71 extending through aligned apertures 73, 75, 77, the latter of which are threaded. Similar collars 79 on the cord clamp 67 extend through the apertures 75 to facilitate alignment between the cord clamps 65, 67, on opposite sides of the posts 51, 53. Each cord clamp in addition includes cord gripping projections 81, 83 for engagement with the cord 41 extending through the opening 19 and between the cord clamps 65, 67.

In addition, each cord clamp 65, 67 comprises a projecting key 85, 87 which extends into corresponding keyways 89, 91 to help maintain alignment of the cord clamps 65, 67 when the screws 69, 71 are tightened on the cord 41. The keyways 89, 91 (FIG. 5) are disposed in alignment on diametrically opposite sides of the opening 19 and at substantially 90° to the aligned posts 51, 53.

Finally, each cord clamp 65, 67 comprises a notch 89, 91, respectively, which in addition to minimizing the amount of material forming each cord clamp 65, 67, also provides means for insertion of fingers of personnel for gripping the electric plug for handling such as when pulling the plug out of a receptacle.

Accordingly, the electric plug of this invention provides an improvement over electric plugs of prior construction by providing not only more complete safety features but also provides a less costly electric plug by employing molded resinous units, such as the cover, the base, and the cord clamps, involving a minimum number of parts.

What is claimed is:

1. An electric plug for use at the end of an electric cord, comprising a base and cover each comprised of an electrically insulating material, the base including first and second end surfaces and having opening means therebetween for an electrical cord, two conductor prongs extending from the second end surface, the cover comprising a tubular wall, an open end, and an opposite closed end wall which end wall has prong-receiving apertures, the tubular wall enclosing the base with the closed end wall adjacent to the second end surface and with the prongs extending through the apertures, the first end surface closing the open end of the cover, locking means between the base and cover for holding the body and cover together, cord-gripping means mounted on the first end surface and comprising post means and cord clamping means, the post means extending from and being integral with the base, the cord-gripping means comprising a pair of cord-clamping member attached to the post means and having interengaging means between the clamping members for gripping an electric cord, and the base and the cord-clamping members comprise interfitting keys and keyways to prevent excessive twisting of the cord.

2. The electric plug of claim 1 in which the post means comprise a pair of posts spaced on opposite sides of the opening means.

3. The electric plug of claim 2 in which the body and posts comprise a unified molded member of a dielectric resinous material.

4. The electric plug of claim 3 in which the resinous material is a long chain synthetic polymeric amide.

* * * * *